US007073308B2

(12) United States Patent
Dyke et al.

(10) Patent No.: US 7,073,308 B2
(45) Date of Patent: Jul. 11, 2006

(54) UNIVERSAL AUTOMATED PLASTIC CONTAINER CLOSING SYSTEM

(75) Inventors: Joseph D. Dyke, Stratford, CT (US); Thomas C. Lynch, Branford, CT (US); Michael Shaun Farrier, Watertown, CT (US)

(73) Assignee: Inline Plastics Corporation, Shelton, CT (US)

( * ) Notice: Subject to any disclaimer, the term of this patent is extended or adjusted under 35 U.S.C. 154(b) by 95 days.

(21) Appl. No.: 10/738,574

(22) Filed: Dec. 17, 2003

(65) Prior Publication Data

US 2005/0132666 A1 Jun. 23, 2005

(51) Int. Cl.
*B65B 51/18* (2006.01)

(52) U.S. Cl. ..... 53/377.6; 53/376.3; 53/376.7

(58) Field of Classification Search ..... 53/377.6, 53/467, 267, 282, 376.3, 376.4, 376.7
See application file for complete search history.

(56) References Cited

U.S. PATENT DOCUMENTS 2,842,920 A 7/1958 Carkhuff et al.
2,971,443 A 2/1961 Striplin
2,998,688 A 9/1961 Randles, Jr.
3,191,353 A * 6/1965 Chidsey, Jr. ..... 53/48.7
3,299,615 A 1/1967 Singer
3,780,493 A * 12/1973 Baker ..... 53/287
3,914,917 A * 10/1975 Young ..... 53/434
4,716,708 A * 1/1988 Ochs ..... 53/314
5,493,848 A 2/1996 McKibben
5,687,543 A * 11/1997 Shing-Tak Lam ..... 53/136.4

* cited by examiner

*Primary Examiner*—Louis K. Huynh
*Assistant Examiner*—John Paradiso
(74) *Attorney, Agent, or Firm*—Melvin I. Stoltz

(57) ABSTRACT

By providing two endless loop belt drive assemblies forming a belt driven sealing section, a highly efficient and effective automatic, universally applicable, container closing system has been achieved which is capable of securely lockingly engaging both locking lug/receiving well containers and perimeter seal containers. In the present invention, the two cooperating endless loop belt drive systems are mounted in juxtaposed, spaced, cooperating relationship with each other and are positioned for simultaneously closing and securely engaging the entire locking elements formed on the flanges of one side of the container. In addition, the spaced distance between the two belt drive assemblies is adjustable, as well as the position of the spaced distance relative to a conveyor. In this way, all containers are to be closed by this system.

26 Claims, 9 Drawing Sheets

UNIVERSAL AUTOMATED PLASTIC CONTAINER CLOSING SYSTEM

TECHNICAL FIELD

This invention relates to automated production equipment and, more particularly, to universally employable equipment for enabling the automatic closing and sealing of plastic containers regardless of the locking/sealing system employed.

BACKGROUND ART

In order to enable various products, particularly food products, to be produced and sold at competitive prices, substantial effort has been expended in creating equipment which is capable of automated filling of suitable containers with the desired product and automated closing and sealing of the filled containers. In this regard, one type of container, which has become extremely popular in the food industry, are transparent, plastic containers. One such container is the clamshell container which typically incorporates a base, in which the food product is retained, and an integrally attached lid which is constructed for arcuate pivoting movement relative to the base. In addition, both the base and lid of the container incorporates flanges on which cooperating sealing lugs or interlocking elements are formed, which are lockingly engaged with each other to close and seal the container.

Another principal container is a plastic container which incorporates either a separate base and lid or a hinged lid and base, with each component having a cooperating perimeter seal. By employing sealing flanges which surround the base and lid, the components are secured together by lockingly interengaging the cooperating perimeter sealing components.

In order to assist manufacturers of the particular food product to be able to manufacture and distribute their product efficiently and economically, container filling and closing systems have been developed. In this regard, substantial effort has been expended in improving such equipment, in order to achieve a container closing and/or filling system which effectively satisfies all of the requirements of the food manufacturer. However, in spite of the substantial effort expended, such a system does not exist.

One of the particular problems which has plagued this industry, is the inability of prior art container closing systems to repeatedly and reliably securely engage the locking lugs or locking elements formed on the plastic containers or the entire interlocking perimeter seals along the length of the container. Typically, prior art systems employed to close containers with locking lugs/elements advance the locking lugs/elements of the plastic containers through fastening wheels, which force the locking lugs/elements into engagement with each other. However, it has been found that these prior art systems are incapable of assuring that the locking lugs/elements are maintained in locked engagement after passage through the wheels.

Similar prior art problems exist with the systems employed to close perimeter seal containers. In these systems, belt drive members are employed to contact the top of the container in an attempt to force the lid downwardly into locked engagement with the base. However, these systems have been found to be ineffective in achieving the desired goal. Instead, these prior art systems apply insufficient pressure, leaving the seals open or disengaged in certain areas or, alternatively, excess pressure is applied, causing the container to buckle or deform.

In attempting to solve this problem, heavy gauge material has been employed to resist the compression forces. Unfortunately, this solution is extremely costly, and has not proven to be universally successful.

In most container constructions, employing locking lugs and receiving wells, the locking lugs are typically formed in the flange extending from the front edge of the container, while the receiving wells are formed by the flange extending from the front edge of the base. In attempting to securely engage the locking lugs and receiving wells, the prior art automated, container closing systems advance the flanges through rotating wheels which force the locking lugs/receiving wells into engagement with each other. However, it has been found that in most instances, although the leading locking lug/well is engaged after passage through the rotating wheels, this leading locking lug/well becomes disengaged as the second locking lug/well passes through the rotating wheels for engagement thereof.

As a result, these prior art container closing systems result in the production of partially closed containers, while the prior art perimeter sealing containers are also partially closed or crushed. Although numerous alternate constructions in such systems have been pursued in an attempt to solve these recurring problems, such prior art systems have been incapable of fully satisfying this need.

Furthermore, no single system has been developed which is capable of closing and sealing both types of containers. Consequently, separate equipment or machines are required for each container type.

Therefore, it is a principal object of the present invention to provide a fully automated, universally applicable, product holding container closing system which is capable of completely sealing any desired product holding container without any containers being partially sealed, partially closed, and/or crushed.

Another object of the present invention is to provide a fully automated, universal, product holding container closing system having the characteristic features described above, which is capable of consistently, reliably, efficiently, repeatedly, and dependably producing fully closed containers.

Another object of the present invention is to provide a fully automated, universal product holding container closing system having the characteristic features described above which is fully automated, requiring virtually no manual effort to achieve the desired result.

Another object of the invention is to provide a fully automated, universal product holding container closing system having the characteristic features described above which is capable of completely sealing any container, regardless of the particular configuration employed and regardless of the sealing elements used on the container.

Other and more specific objects will in part be obvious and will in part appear hereinafter.

SUMMARY OF THE INVENTION

By employing the present invention, all of the difficulties and drawbacks found in the prior art have been overcome and a highly efficient and effective automatic, universally applicable, container closing system has been achieved which is capable of securely lockingly engaging both locking lug/receiving well containers and perimeter seal containers. In accordance with the construction of the present invention, assurance is provided that both locking lugs/wells formed in the flanges of the clamshell containers are fully engaged and interlocked, free from any disengagement of the first locking lug/well when the second locking lug/well is being engaged. In addition, when perimeter seal containers are employed, the present invention provides a completely sealed container, without any open or unlocked areas and without applying pressure to the top of the container cover in order to achieve the seal engagement.

In accordance with the present invention, two cooperating endless loop belt drive systems are mounted in juxtaposed, spaced, cooperating relationship with each other and are positioned for simultaneously closing and securely engaging the entire locking elements formed on the flanges of one side of the container. In this regard, the entire length of the perimeter seal bearing flanges of a container being closed passes through the two endless loop belt drive systems, causing the locking elements formed in the flanges to be securely engaged with each other. Similarly, by spacing the two endless loop drive belt systems for cooperatively, simultaneously engaging the top of the flange and the bottom of the flange of a locking lug/receiving well bearing container, the locking lugs/wells formed in the flanges are securely engaged with each other simultaneously, thereby completely eliminating all of the prior art difficulties.

In order to assure that the automated, container closing system of the present invention is capable of being employed for securely sealing virtually all container constructions, regardless of the size, shape, or construction of the container, the dual endless loop drive belt systems of the present invention are fully adjustable, along with the entire container handling system on which it is employed. In this way, locking lug/well bearing clamshell containers and all perimeter sealing containers, whether clamshell or two piece, are capable of being effectively, efficiently, and reliably lockingly closed by employing the present invention.

In order to achieve a universally employable container closing system, the system incorporates a fully adjustable container transfer assembly on which the desired product bearing containers are placed for being advanced into engagement with the flange locking and sealing zone. As typically employed, an endless loop conveyor belt is incorporated into this transfer assembly in association with a plurality of adjustable guide rails which are positioned for controlling the movement of the product bearing container on the conveyor belt, assuring that these containers are consistently positioned in the precisely desired orientation for delivery to the flange locking and sealing zone in the precisely required position.

By employing the closing system of the present invention, secure, dependable, and consistently repeatable locking and sealing of all containers is realized, whether the containers incorporate locking lug/wells formed in the flanges of the containers or the flanges incorporate perimeter sealing elements formed in either a clamshell container or a two-piece container. However, the present invention is capable of lockingly engaging and securely affixing the entire outer peripheral edge of containers incorporating perimeter seals in a fully automated system, thereby completely eliminating the prior art inabilities.

In accordance with the present invention, the dual, endless loop, belt drive system construction detailed above is employed for sealing one long edge of the container incorporating the perimeter seal. In addition, a flange engaging rail is positioned in juxtaposed, spaced, parallel relationship to the endless loop belt drive system for receiving and closing the perimeter seal formed on the opposed long edge of the container. In achieving this result, a flange engaging rail incorporates two elongated cooperating rail members which are maintained in a precise spaced relationship to each other, for receiving the perimeter seal bearing flange of the container and forcing the perimeter seal of the container into locked engagement as the container is advanced along the length thereof by the conveyor belt.

As is evident from the foregoing detailed discussion, a wide variety of containers, particularly plastic containers constructed for receiving and retaining food products, are able to be effectively and efficiently closed and sealed in their entirety, in a completely automated, highly reliable manner. In addition, by constructing the container closing system of the present invention with a wide variety of various adjustable components, virtually any container, regardless of size and shape, is capable of being transferred on the conveyor system of the container closing system of the present invention while also having the cover and base thereof completely sealed in locked engagement, with virtually no manual input.

The invention accordingly comprises the features of construction, combinations of elements and arrangement of parts which will be exemplified in the construction hereinafter set forth, and the scope of the invention will be indicated in the claims.

THE DRAWINGS

For a fuller understanding of the nature and objects of the invention, reference should be had to the following detailed description taken in connection with the accompanying drawings, in which.

DETAILED DESCRIPTION

Figure 1:
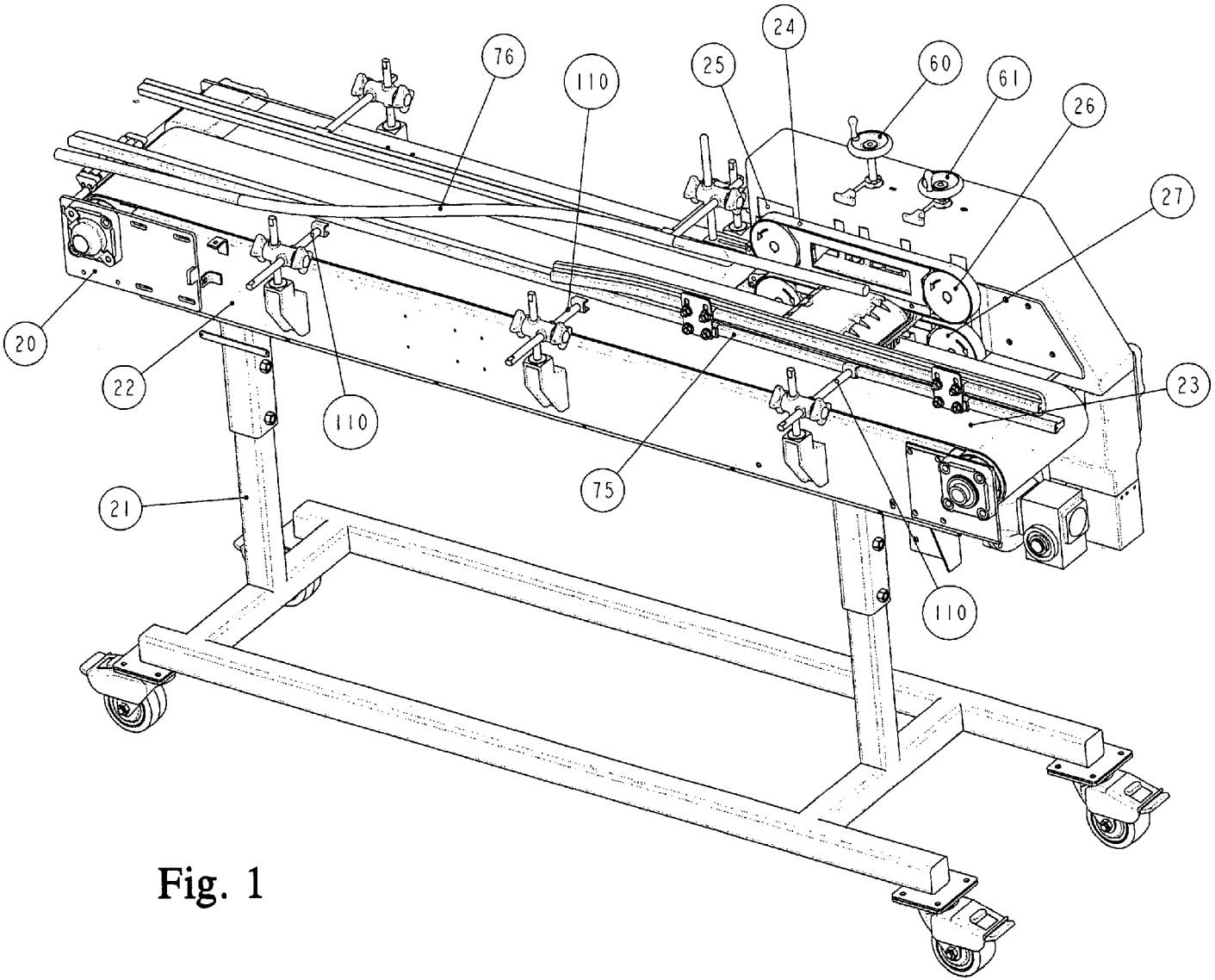
FIG. 1 is a perspective view of the automated, universal, product holding container closing system of the present invention.

By referring to FIGS. 1–11, along with the following detailed discussion, the construction and operation of the preferred automated, universal, product-holding container closing system 20 of the present invention can best be understood. As will be evident from the following detailed discussion, alternate embodiments and constructions may be implemented without deviating from the present invention. Consequently, it is to be understood that the embodiment shown in the drawings, and detailed in the following disclosure, is provided for exemplary purposes only and is not intended as a limitation of the present invention.

As shown in FIGS. 1–11, automated, universal container closing system 20 comprises supporting frame structure 21 on which is mounted supporting or conveyor bed table 22 which incorporates conveyor belt 23. In the preferred construction, frame structure 21 is adjustable, in order to enable table/bed 22 to be raised and/or lowered into any desired position. In addition, conveyor belt 23 preferably comprises an endless or continuous belt on which the desired product containers are positioned and advanced for secure affixation of the lid to the base. In addition, conveyor belt 23 is preferably constructed to be driven at variable, selected speeds.

Figure 10:
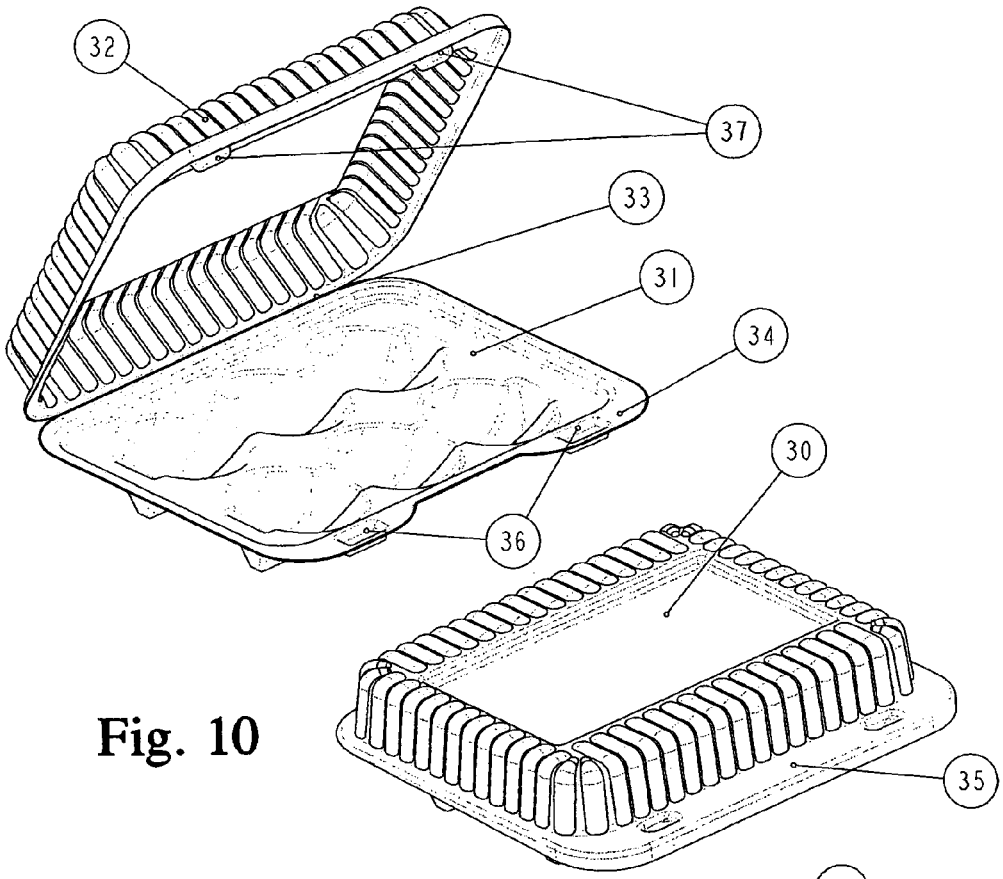
FIG. 10 is a perspective view of a locking and receiving well container.
Figure 11:
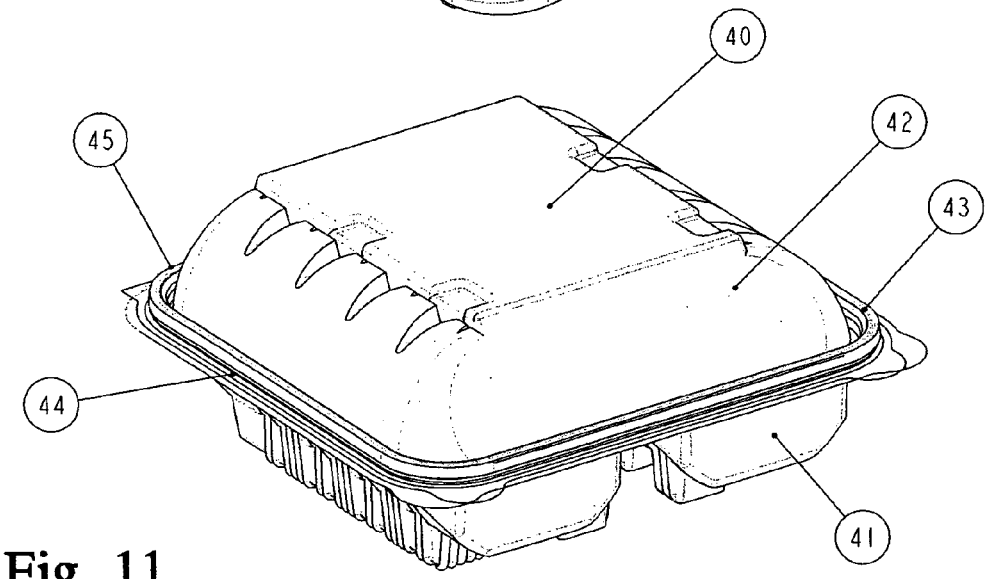
FIG. 11 is a perspective view of a perimeter seal container.

Numerous product containers exist in the marketplace which are employed by various manufacturers. In particular, as discussed above, manufacturers of food products, such as baked goods, typically employ plastic containers as shown in FIGS. 10 and 11. In FIG. 10, a typical clamshell product container 30 is depicted comprising base 31 and cover 32, both of which are pivotally secured to each other along integrally attached hinge 33, thereby forming the clamshell configuration. For exemplary purposes, container 30 is depicted in a rectangular shape. However, any alternate shape can be employed.

Clamshell container 30 also incorporates a forwardly protruding lip or flange 34 extending from base 31, and a forwardly protruding lip or flange 35 extending from cover 32. Lips/flanges 34 and 35 are constructed for cooperating with each other, in overlying, aligned engagement, while also incorporating cooperating locking means formed therein. In this regard, two, generally rectangular shaped receiving zones or wells 36 are formed directly in lip/flange 34, with two, cooperating locking or engaging lugs or elements 37 formed in lip/flange 35.

By employing this construction, whenever cover 32 is arcuately pivoted into overlying closing engagement with the base 31 for closing and securing cover 32 in the desired position, flanges 34 and 35 are placed in overlying aligned relationship with each other, while locking lugs/elements 37 are forced into secure interengagement with receiving wells 36. When fully engaged, cover 32 is securely affixed to base 31.

As discussed above, prior art container closing systems are generally incapable of completely sealing both locking lugs/elements of a clamshell container. Since the prior art systems employ two cooperating rollers or wheels which are vertically positioned in cooperating relationship, the systems force the first or leading locking lug/element into engagement with its cooperating well, as the two components pass through the rollers/wheels. However, when the second pair of locking lugs and receiving well reaches the two rollers, it has been found that the forced engagement of the second locking lug into the second well causes the first pair of locking lugs and well to be separated. As a result, full, secure, locked engagement of the container in its entirety is not always achieved.

In FIG. 11, a second, most commonly employed plastic container 40 is depicted which comprises base 41 and cover 42. In this construction, base 41 incorporates flange 44 peripherally surrounding the entire edge of base 41, while cover 42 incorporates flange 43 formed in peripheral, surrounding engagement therewith.

In addition, container 40 is typically constructed in a clamshell configuration, with cover 42 pivotally secured to base 41 along hinged edge 45. Alternatively, in some embodiments, cover 42 and base 41 are produced as separate elements. In addition, in both constructions, flanges 43 and 44 are constructed for cooperative secure locking interengagement with each other, securely sealing container 40 in its closed and fully engaged configuration.

In order to provide the desired secure and complete affixation of the entry zones of containers 30 and 40, automated container closing system 20 incorporates belt driven sealing section 24. As shown in FIGS. 1–9 and fully detailed below, belt driven sealing section 24 incorporates support plate or block 25, on which cooperating, endless loop belt drive assemblies 26 and 27 are operationally mounted. As depicted, endless loop belt drives assemblies 26 and 27 are positioned in juxtaposed, spaced, cooperating, vertically aligned relationship with each other, establishing elongated gap 28 formed therebetween.

In the preferred construction, endless loop belt drive assembly 26 comprises drive wheels 50 and 51 and endless loop drive belt 52, which is mounted to wheels 50 and 51. Furthermore, each drive wheel 50 and 51 is mounted to support plate 25 for rotational movement relative thereto, causing drive belt 52 to be continuously driven by the rotational movement of wheels 50 and 51.

Similarly, endless loop belt drive assembly 27 comprises drive wheels 53 and 54, with endless loop drive belt 55 mounted to wheels 53 and 54. Furthermore, each drive wheel 53 and 54 is mounted to support plate 25 for rotational movement relative thereto, causing drive belt 55 to be continuously driven by rotational movement of wheels 53 and 54.

Figure 6:
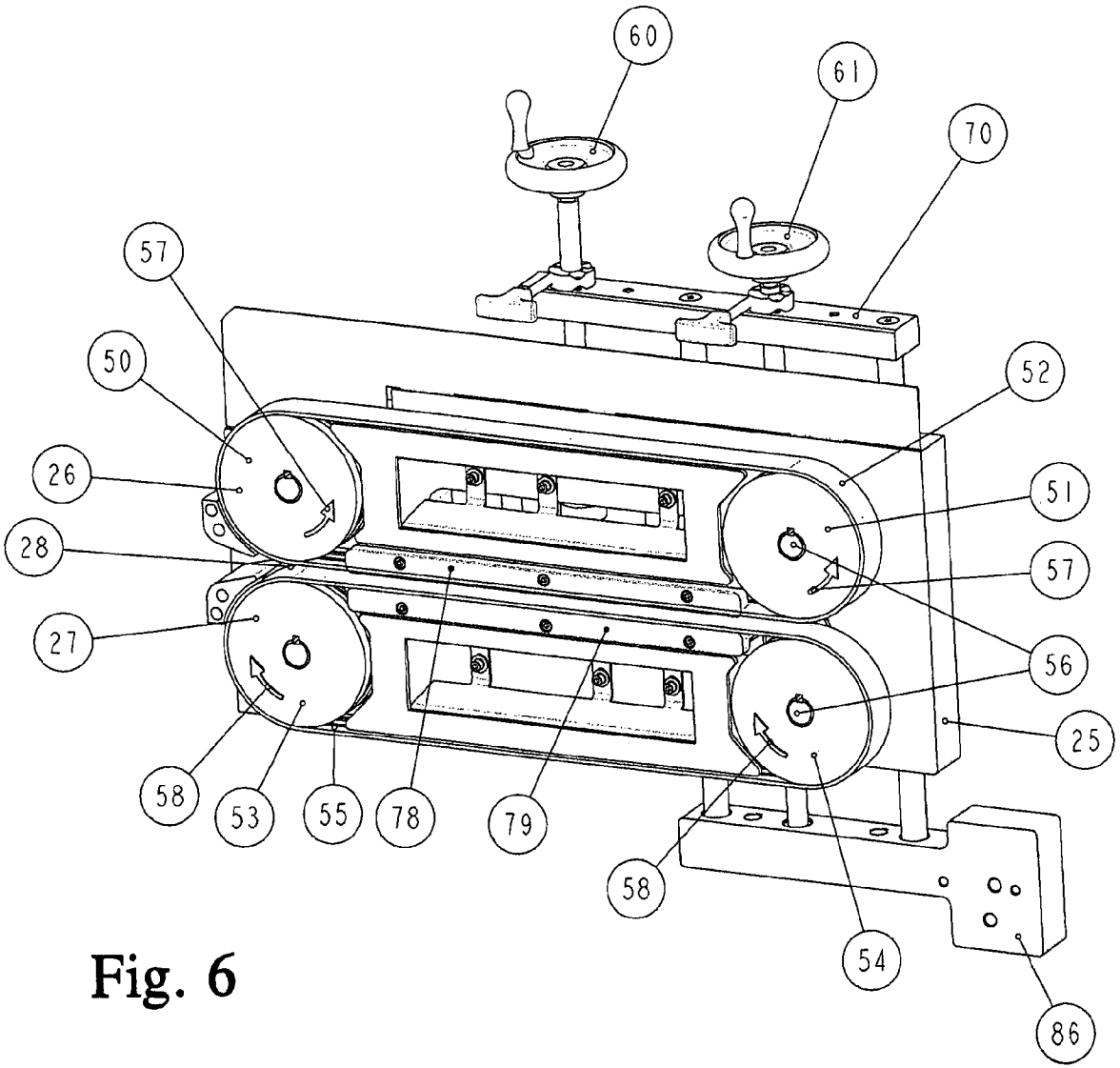
FIG. 6 is a front perspective view of the belt driven sealing section of the present invention depicted isolated from the machine and with the cover thereof removed.
Figure 7:
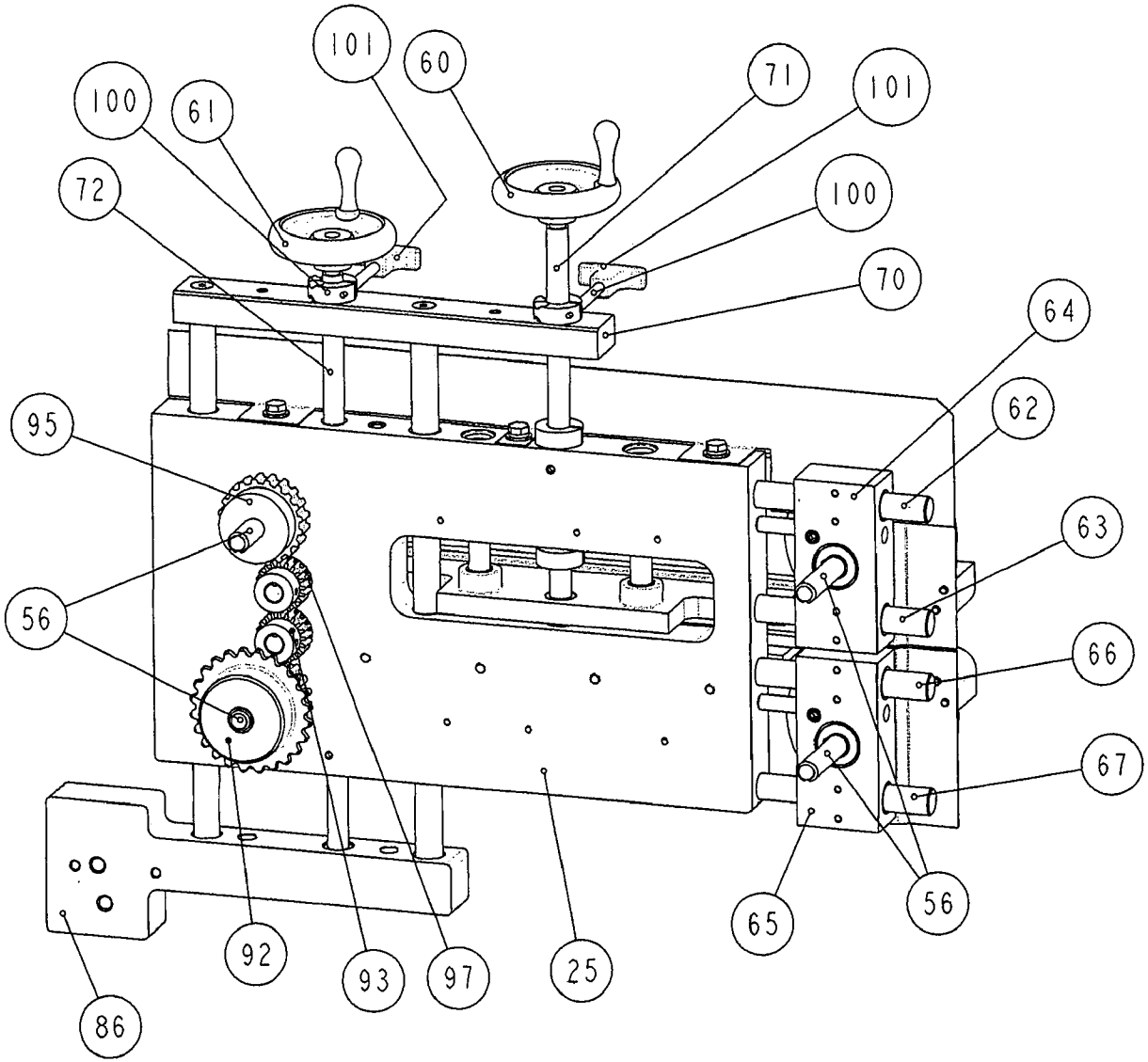
FIG. 7 is a rear perspective view of the belt driven sealing section of FIG. 6.
Figures 8, 9:
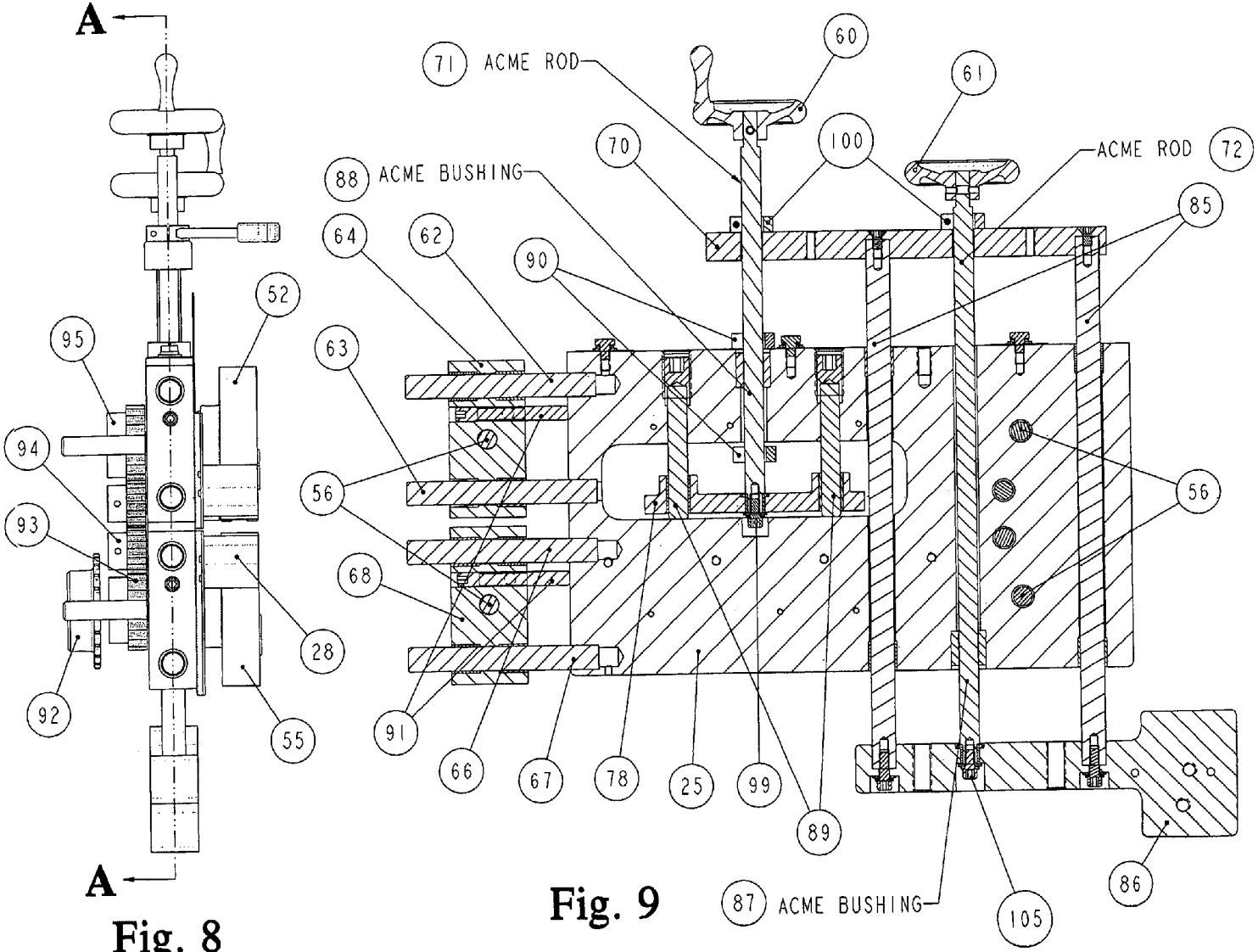
FIG. 8 is a side elevation view of the belt driven sealing section of FIG. 6.
FIG. 9 is a cross-sectional, front elevation view taken along line A—A of FIG. 8.

Drive wheel 50, 51, 53, and 54 are individually mounted to support shafts 56, with each support shaft 56 being connected to rotational drive means for causing each drive wheel to be rotated in the desired direction. Typically, a conventional drive motor and gear system is employed for providing the rotational driving forces to shafts 56, with any desired configuration being employed. In the preferred construction, as shown in FIGS. 6–8, gear member 95 shares it support shaft with chain sprocket 92 which is connected to a chain drive (not shown) which is controllably driven by a motor (not shown). Chain drive to sprocket 92 provides direct drive to wheel 54. Drive to wheel 51 is obtained through gear train 93 consisting of gears 95 and 93. The gear train arrangement is such as to provide correct rotation to wheel 51. Rotation of wheels 53 and 50 is obtained through belts 52 and 55. As shown in FIG. 6, drive wheels 50 and 51 are rotationally driven in the direction shown by arrow 57, while drive wheels 53 and 54 are rotationally driven in the direction shown by arrow 58.

In view of this construction, and as clearly shown in FIGS. 1–5, the portion of endless loop belts 52 and 55 which forms gap 28 are driven for movement in the same direction as conveyor belt 23 of conveyor bed 22. In this way, when any container to be closed is brought into engagement with belt driven sealing section 24, the longitudinal movement of endless loop belts 52 and 55 acting upon the container is complementary with the movement of the container on conveyor belt 23.

In order to enable automated container closing system 20 of the present invention to be quickly and easily adapted for securely closing any desired container, regardless of the size, shape, and/or configuration of the particular container, closing system 20 is constructed to be fully adjustable. In this regard, belt driven sealing section 24 is constructed with endless loop belt drive assemblies 26 and 27 fully adjustable, both relative to conveyor belt 23 as well as relative to each other.

As depicted, belt driven sealing section 24 incorporates belt gap adjustment control wheel 60 and belt height adjustment control wheel 61, both of which are mounted as integral components of belt driven sealing section 24. By arcuately rotating adjustment control wheel 60, the vertical height of gap 28, formed between endless loop belt drive assemblies 26 and 27, is increased and/or decreased. In this way, gap 28 is easily adjusted to accommodate the precise, spacing or dimension required for any particular container.

Furthermore, by arcuately rotating adjustment control wheel 61, support plate 25 is controllably moved vertically, causing both endless loop belt drive assemblies 26 and 27 to be raised and lowered simultaneously. By employing adjustment control wheel 61, the precise position of gap 28 is quickly and easily controlled, thereby assuring that the flanges of any container configuration are precisely positioned for entry and passage through gap 28.

Figure 4:
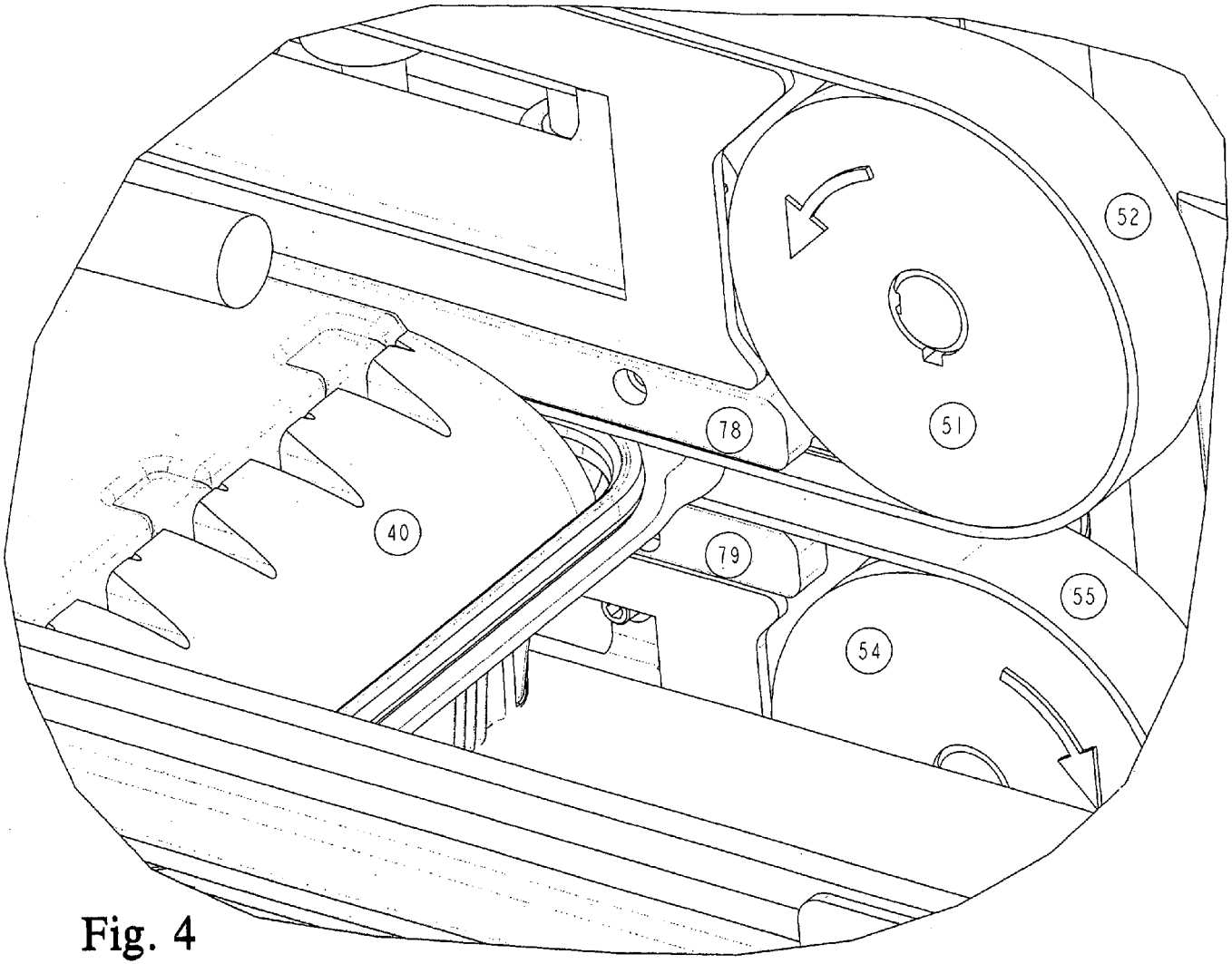
FIG. 4 is a greatly enlarged perspective view of the belt driven sealing section of the automated product holding container closing system of the present invention depicting a container fully engaged therewith.

In order to assure the desired secure, locking interengagement of sealing lugs/elements 37 in receiving wells or zones 36, endless loop belt drive assembly 26 incorporates a reinforcing plate 78, while endless loop belt drive assembly 27 incorporates reinforcing plate 79. Reinforcing plates 78 and 79 are positioned between the drive wheels in direct contact with the associated endless loop belt. As best seen in FIG. 4, reinforcing plates 78 and 79 form an integral component of endless loop belt drive assemblies 26 and 27, and are positioned in spaced relationship with each other.

In addition, as depicted, reinforcing plates 78 and 79 are located for controlling the vertical movement of endless loop belts 52 and 55, thereby preventing endless loop belts 52 and 55 from being forced or flexed out of continuous engagement with the flanges of containers 30. As a result, continuous, dependable, and reliable controlled locking engagement of the flanges of containers 30 and 40 are provided, assuring the user that sealed, locking engagement of the locking elements of the flange is dependably achieved. In addition, as detailed below, reinforcing plate 78 is vertically movable in order to adjust the vertical spacing or height of gap 28. In this way, any dimension is easily accommodated.

In order to enable belt driven sealing section 24 to be independently controllable and fully adjustable for achieving all of the goals and objectives of the present invention, support plate 25 is adjustably mounted to holding blocks 70 and 86 in a manner which enables support plate 25 to be vertically movable relative thereto. In addition, drive wheels 50 and 53 are constructed for enabling the spaced distance between these drive wheels and drive wheels 51 and 54 to be easily adjusted.

In attaining the desired adjustability, the preferred construction of endless loop drive belt assembly 26 incorporates support rods 62 and 63 integrally mounted, in parallel relationship to each other, to support plate 25 extending substantially horizontally therefrom. In addition, plate 64 is mounted to support rods 62 and 63, with plate 64 being movably adjustable along the length of rod 62 and 63. In addition, support shaft 56 is rotationally journalled in plate 64 with drive wheel 50 mounted thereto. In this way, the spaced distance between drive wheels 50 and 51 can be adjusted to ensure proper tension of belt 52.

Similarly, support rods 66 and 67 are integrally affixed to support plate 25, extending therefrom in parallel relationship to each other. In addition, plate 65 is mounted to support rods 66 and 67 for being horizontally movable relative thereto. In addition, support shaft 56 is rotationally journalled in plate 65 with drive wheel 53 mounted thereto. In this way, the space distance between drive wheels 53 and 54 can be adjusted to ensure proper tension of belt 55.

Once plate 64 has been adjusted into the precisely desired position, plate 64 is securely affixed to support rods 62 and 63 in order to maintain this precisely desired position. Similarly, once plate 65 has been adjusted into its precisely desired position, plate 65 is securely affixed to support rods 66 and 67 in order to maintain this precisely desired position. In addition, by employing two support rods for enabling each drive wheel to be supported and freely adjustable, the horizontal relationship of each drive wheel of each drive assembly relative to its associated drive wheel is assured.

In order to obtain the desired separate adjustability of endless loop belt and drive assembly 26 relative to endless loop belt drive assembly 27, belt gap adjustment control wheel 60 is affixed to shaft 71. In the preferred construction, shaft 71, which may be threaded along its entire length, is rotationally journalled near its proximal end to fixed holding block 70. In addition, shaft 71 passes through a portion of support plate 25 terminating at its distal end with reinforcing plate 78.

In the preferred construction, as shown in FIG. 9, reinforcing plate 78 is mounted to support plate 25 by employing guide rods 89. In order to provide reinforcing plate 78 with vertical movability, guide rods 89 are affixed at one end and freely movable at the opposed end. In this regard, rods 89 may be affixed to reinforcing plate 78 while being slidably mounted within support plate 25 or, alternatively, rods 89 may be securely mounted within support plate 25 and connected to reinforcing plate 78 in a manner which enables reinforcing plate 78 to move along the length of rods 89. Regardless of which mounting system is employed, the precisely desired alignment of reinforcing plate 78 relative to reinforcing plate 79 is maintained, while still enabling reinforcing plate 78 to be controllably movable in a vertical direction relative to reinforcing plate 79.

In order to enable reinforcing plate 78 to be adjustable with substantial precision in order to obtain a spaced distance from reinforcing plate 79 which exactly matches the desired vertical dimension, shaft 71 preferably comprises a specially formed threaded rod which is threadedly engaged with cooperating bushing 88 mounted in support plate 25. In the preferred construction, the threaded engagement of shaft 71 with bushing 88 requires several revolutions of shaft 71 to produce a small axial movement. In this way, as is evident from the further detailed disclosure below, precisely controlled positioning of reinforcing plate 78 is attained. Furthermore, in the preferred construction, this precise control is attained by forming a shaft 71 as an Acme rod which cooperates with bushing 88 formed as an Acme bushing.

In completing this construction, the distal end of shaft 71 is rotationally affixed to reinforcing plate 78 using bushing 100 and captive screw 99. In this away, the axial movement of shaft 71 directly controls the movement of reinforcing plate 78 relative to reinforcing plate 79. In addition, in the preferred construction, stops 90 are mounted to rod 71 in cooperating association with a plate plate 25. The stops allow the user to preset particular gap heights. This facilitates ease of setup when changing from one container to another. In this way, vertical adjustability of shaft 71 is attainable and the range of movement of reinforcing plate 78 is additionally controlled.

By employing this construction, the rotational movement of adjustment control wheel 60 causes reinforcing plate 78 to move upwardly or downwardly, depending upon the rotational direction of shaft 71. Since rod 71 is constrainied by bushing 88 in plate 25, the distal end of shaft 71 is able to controllably raise and/or lower reinforcing plate 78 in its entirety. In this way, the spaced distance between reinforcing plate 78 and reinforcing plate 79 is easily controlled. In addition, by employing the special threaded construction of shaft 71 and bushing 88, reinforcing plate 78 is easily controlled with a high degree of precision.

In order to assure that the precisely desired spaced distance is maintained, once the distance has been established, locking collar 100 is mounted to holding block 70 peripherally surrounding shaft 71. By rotating associated control knob 101, collar 100 clamps shaft 71, assuring that the precisely desired position, once established, is maintained.

In addition to precisely controlling the vertical spacing of gap 28 formed between endless loop belt drive assemblies 26 and 27, in the manner detailed above, the position of gap 28 relative to conveyor belt 23 is also precisely controlled. As detailed below, the position of gap 28 relative to conveyor belt 23 is achieved by vertically moving support plate 25 in its entirety. Furthermore, in order to assure that any such vertical movement is precisely maintained in the desired vertical axis, support plate 25 is slidably mounted to guide rods 85 which are securely affixed between holding blocks 70 and 86.

In order to attain the desired adjustment of support plate 25, adjustment control wheel 61 in cooperating relationship with shaft 72 is employed. In the preferred construction, adjustment control wheel 61 is affixed to shaft 72 with shaft 72 rotationally journalled to fixed bracket member 70 near its proximal end. In addition, the distal end of shaft 72 is rotationally mounted to bolt 105 which is secured in holding bracket 86, in a manner which enables shaft 72 to be freely rotatable relative to fixed bracket 86.

Furthermore, shaft 72 extends through support block 25 and is threadedly engaged therein with bushing 87. In the preferred embodiment, shaft 72 and bushing 87 are both constructed in a manner which requires several rotations of shaft 72 in order to produce small axial movements thereof. This is most easily achieved, as detailed above, by employing an Acme rod for shaft 72 and an Acme bushing for bushing 87.

With shaft 72 threadedly engaged with bushing 87, while bushing 87 is securely mounted to support plate 25, the rotational movement of shaft 72 causes support block 25 to be raised and/or lowered in its entirety, depending upon the rotational direction of shaft 72. Typically, control wheel 61 is arcuately rotated, causing shaft 72 to rotate therewith. This rotation movement causes the threaded engagement of shaft 72 with bushing 87 to cause support block 25 to be moved in its entirety along rods 85 in the desired direction.

As a result, support block 25, is raised and/or lowered, depending upon the directional rotation of shaft 72, resulting in the positioning of gap 28 in the precisely desired location. Once attained, this position is secured by employing shaft locking collar 100 and handle 101.

In employing container closing system 20 of the present invention, the pre-selected containers are filled with the desired product and then placed on conveyor belt 23 for being securely closed by system 20. As shown in FIGS. 1–5, closing system 20 incorporates guide rail assembly 75 which is mounted to support table or conveyor bed 22 above conveyor belt 23. In addition, by employing adjustable arm assembly 110, guide rail assembly 75 is adjustable relative to belt drive sealing section 24 in order to assure that each container positioned on conveyor belt 23 is controllably maintained in the precisely desired orientation and location for being delivered to and securely lockingly closed by sealing section 24.

In the preferred construction, container closing system 20 also incorporates elongated closing rod 76 which is constructed for arcuately pivoting the integrally attached cover of clamshell containers 30 and 40 for placing the cooperating front thereof into juxtaposed, spaced, aligned relationship with each other. Alternatively, if desired, the cover may be manually pivoted into the desired position. However, regardless of the method employed for placing the cover in positioned with the base, this orientation is achieved prior to advancing the flanges of clamshell containers 30 and 40 into engagement with belt driven sealing section 24. In addition, whenever a two-piece perimeter sealing container is processed by closing system 20, elongated closing rod 76 is not employed since cover 42 is positioned in cooperating relationship with base 41.

Regardless of whether clamshell containers 30 and 40, or two-piece perimeter sealing containers 40 are being securely lockingly sealed by closing system 20, belt driven sealing section 24 is adjusted into the precisely desired location relative to conveyor belt 23. In this regard, by employing adjustment wheel 61, the precise location of gap 28 of endless loop belt drive assemblies 26 and 27 is adjusted for being located in the precisely required, spaced distance above conveyor belt 23 for enabling the flanges of the container to be advanced through gap 28. In addition, the vertical height of gap 28 is also adjusted using wheel 60 in order to be certain that a particular flange construction is capable of traveling through gap 28, while also being securely locked and completely sealed thereby.

In processing locking lug/well bearing containers 30 on container closing system 20 of the present invention, the adjustments detailed above to endless loop belt drive assemblies 26 and 27 and gap 28 are made prior to employing closing system 20 in its fully automated mode. In addition, guide rail assembly 75 is also adjusted for assuring that containers 30 will be delivered to belt driven sealing section 24 in the precisely desired position. Once these adjustments have been made, pre-filled containers 30 are placed on conveyor belt 23 and continuously advanced through belt driven sealing section 24, wherein each container 30 is securely and completely closed and sealed.

Similarly, whenever perimeter seal container 40 is employed in automated container closing system 20 of the present invention, the same process and procedures detailed above in reference to containers 30 are implemented. In this regard, endless loop belt drive assemblies 26 and 27 are adjusted, along with gap 28, for assuring that the flange members along one side of each perimeter seal container 40 travels along the precisely desired path, through gap 28 of endless loop belt drive assemblies 26 and 27, with endless loop belt drive assemblies 26 and 27 interacting with the locking component of the flange members for secure interengagement thereof.

In addition to positioning guide rail assembly 75 for controlling the position and orientation of each perimeter seal container 40 moving along conveyor belt 23, guide rail assembly 75 is also adjusted for engaging the perimeter seal formed along the side of container 40 opposite the side traveling through endless loop belt drive assemblies 26 and 27. In this way, the secure, locked engagement of the entire perimeter seal of container 40 is quickly, easily, and automatically achieved.

Figure 2:
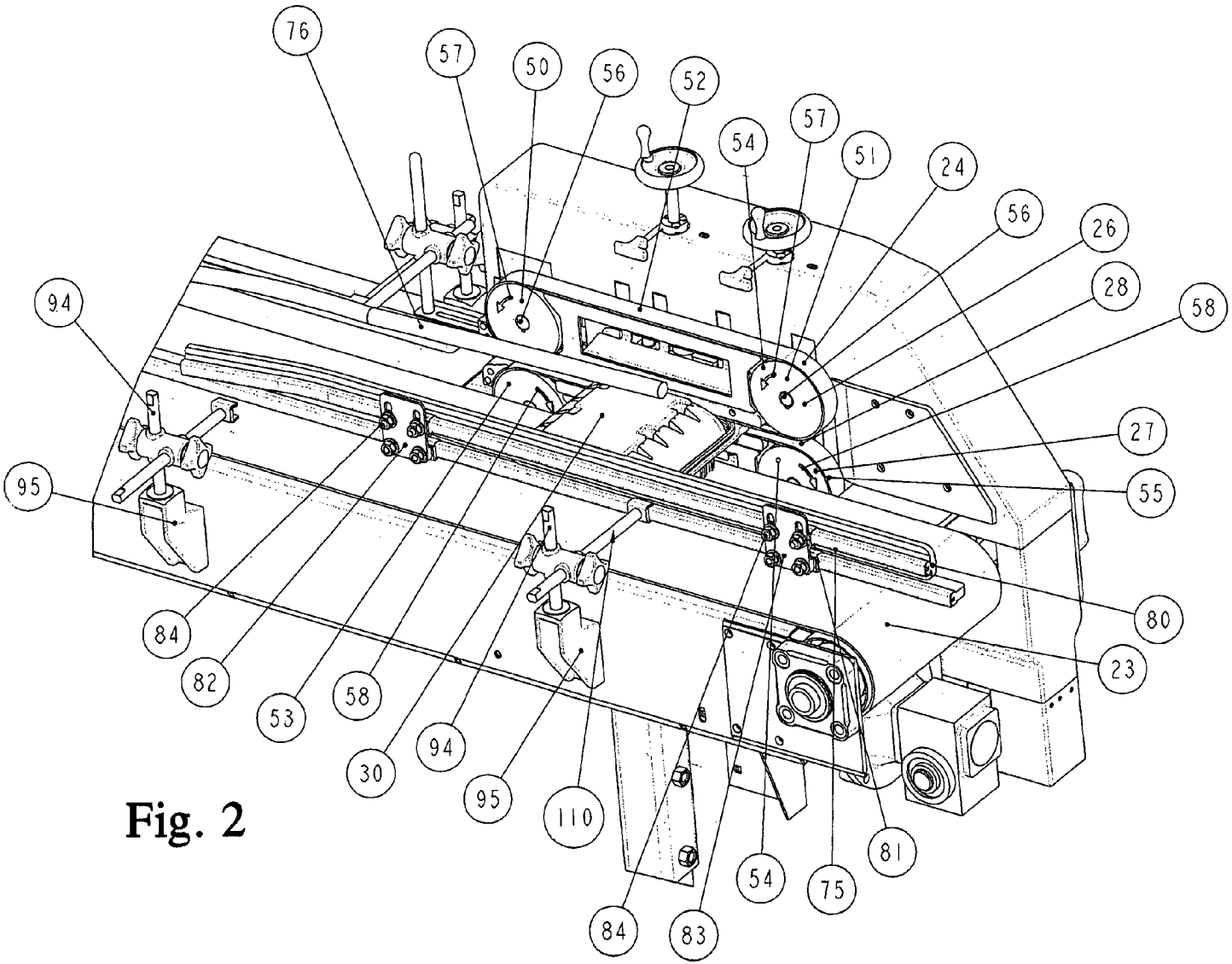
FIG. 2 is an enlarged perspective view of the automated, universal product holding container closing system of the present invention also depicting a container passing therethrough.
Figure 3:
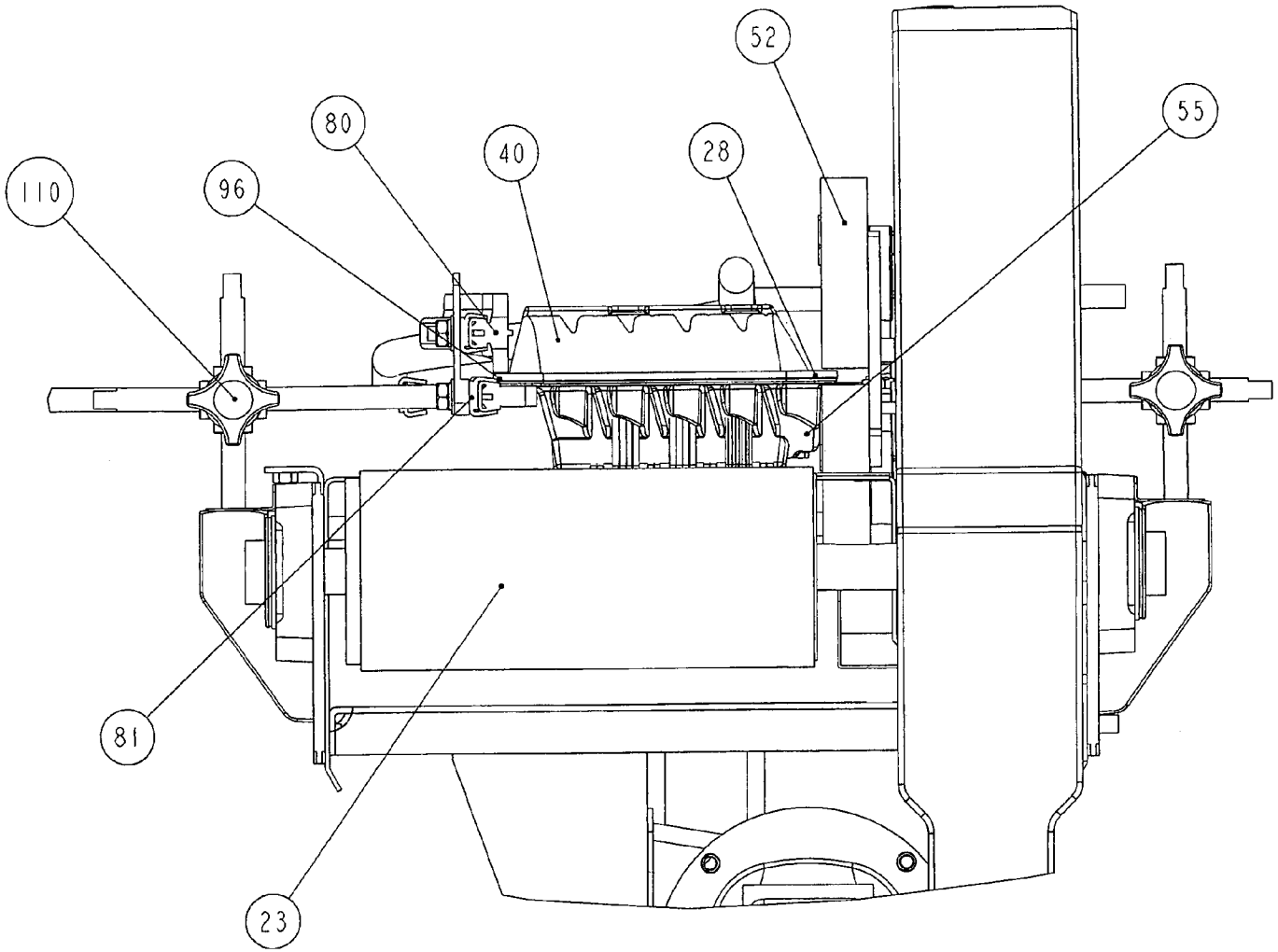
FIG. 3 is an end view of the automated, universal, product holding container system of FIG. 2.
Figure 5:
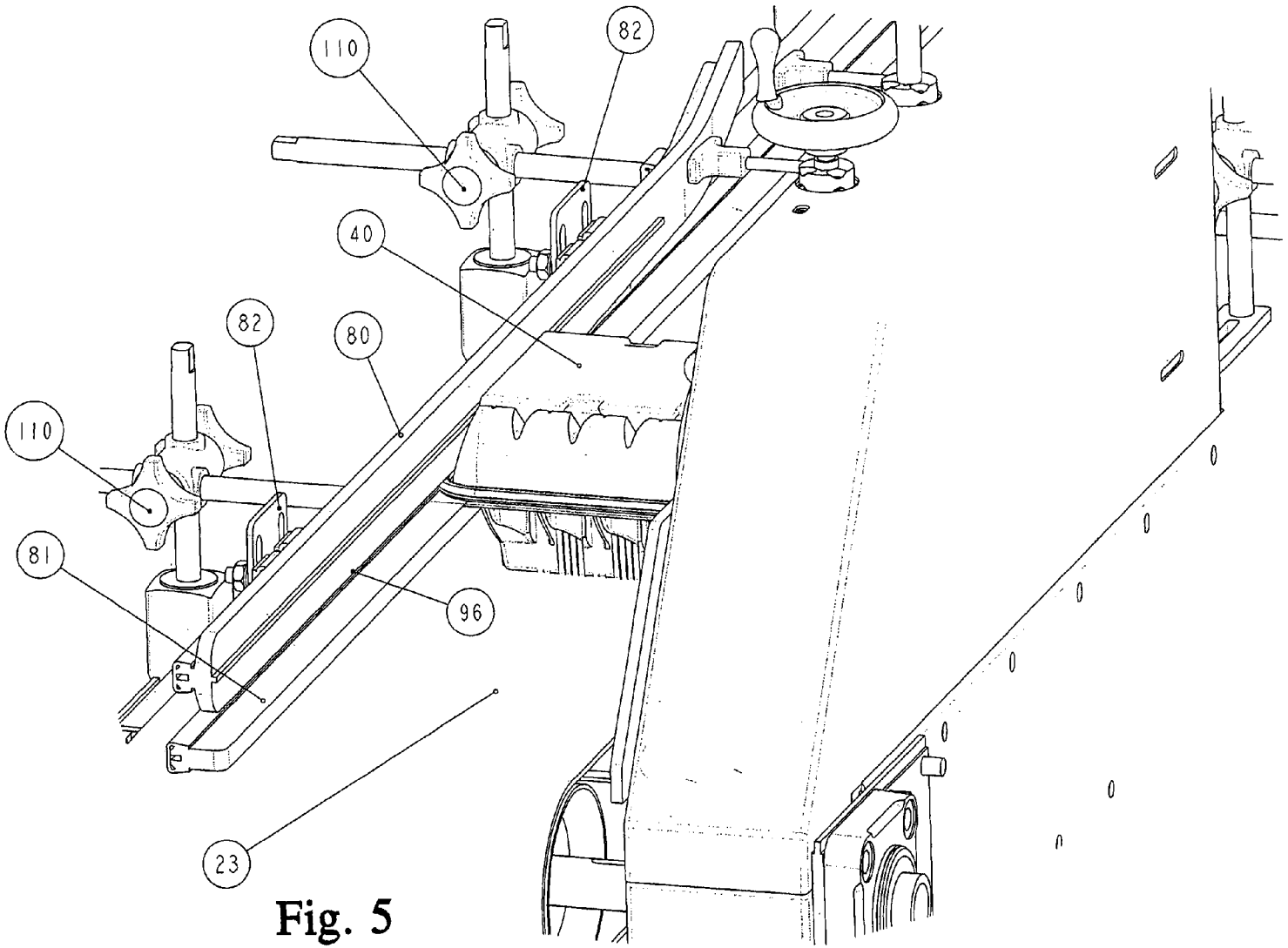
FIG. 5 is a rear perspective view of the automated, universal, product holding container closing system of FIG. 2, showing a closing mechanism for the hinge side.

In order to provide secure, locked interengagement of the perimeter seal formed along the edge opposite the edge traveling through endless loop belt drive assemblies 26 and 27, guide rail assembly 75 incorporates longitudinally extending, cooperating guide rail 81 and adjustable closer bar 80 both of which are best seen in FIGS. 2 and 5. As detailed below, by adjusting the relative position of rail 81 and bar 80, the interlocking flanges of perimeter seal container 40 are forced into secure, locked engagement with each other. In addition, it has been found that by securely lockingly engaging the perimeter seal along two longitudinally extending sides of container 40, the remaining two sides are also simultaneously forced into locked engagement, thereby achieving a completely closed and sealed container.

In the preferred construction, elongated, longitudinally extending guide rail 81 and closer bar 80 are maintained in juxtaposed, spaced, vertically aligned relationship with each other. In order to maintain this position, while also enabling any desired space or gap to be established between rail 81 and bar 80, holding plates 82 and 83 are employed, along with a plurality of threaded rail clip 84. In the preferred construction, threaded rail clips 84 are secured to plates 82 and 83 and longitudinally extending rail 81 and bar 80. In this way, the precise spaced gap 96 between rail 81 and bar 80 is quickly and easily established and maintained.

In setting up container closing system 20 of the present invention for automatically securely closing and locking perimeter seal containers, longitudinally extending rail 81 and bar 80 are adjusted for establishing the precisely required space or gap therebetween which will enable the flanges formed on one longitudinal side of the container to easily enter between rail 81 and bar 80 and, thereafter, be forced into locked interengagement with each other while container 40 is moved along conveyor belt 23. Typically, gap 96 is adjusted to match gap 28 formed between left drive assemblies 26 and 27. In addition, the height of gap 96 above conveyor belt 23 is also adjusted to match the position of gap 28. This adjustment is attained by employing arm assemblies 110. Once container 40 exits from between rail 81 and bar 80, the entire perimeter seal formed thereon is secured and locked in the precisely desired position. In this way, perimeter seal container 40 is quickly and easily automatically transported by container closing system 20 securely affixing cover 42 to base 41.

As is evident from the foregoing detailed disclosure, automated container closing system 20 of the present invention is capable of repeatedly, reliably, and dependably receiving both clamshell containers and perimeter seal containers and automatically lockingly sealing and securely engaging the components thereof. Upon passage through closing system 20, any desired container is securely locked and completely closed in its entirety.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A system for securely affixing locking elements of a lid of a container with cooperating locking elements of a base of the container, said locking elements being formed on flanges extending from the lid and base of the container in cooperating alignment with each other, said system comprising:

A. a support table constructed for enabling containers to be moved thereon;

B. a conveyor belt mounted to the support table and constructed for transferring the containers along the length of the table; and C. a container securing section mounted to the support table and comprising a. a first endless loop belt drive assembly positioned in cooperating relationship with the conveyor, b. a second endless loop belt drive assembly positioned in cooperating relationship with the first endless loop belt drive assembly defining therebetween an elongated, container engaging gap and c. said container engaging extending longitudinally substantially parallel to the surface of the conveyor and positioned for engaging the outwardly extending flanges of the container and dimensioned for compressing the locking elements formed on the flanges into secure interengagement with each other;

d. first control means controllably engaged with the support plate for simultaneously raising and lowering the first and second endless loop belt drive assemblies relative to the conveyor, thereby enabling the position of the elongated gap relative to the conveyor to be easily adjusted for any sized container;

whereby containers moving on the conveyor are advanced into engagement with the container engaging gap of the endless loop drive belt assemblies wherein the locking elements of the container are securely engaged with each other.

2. The system defined in claim 1, wherein each of the endless loop belt drive assemblies are further defined as comprising a first wheel mounted for rotational movement about a central axis thereof, a second wheel mounted for rotational movement about a central axis thereof and positioned directly adjacent to the first wheel in cooperating planar alignment therewith, and an endless loop belt member peripherally surrounding the first wheel and the second wheel and constructed for being rotationally driven by the rotational movement of the first wheel and the second wheel.

3. The system defined in claim 2, wherein the elongated, container engaging gap formed between the first endless loop belt drive assembly and the second endless loop belt drive assembly is further defined as extending substantially parallel to the surface of the conveyor.

4. The system defined in claim 3, wherein the elongated, container engaging gap formed between the first endless loop drive belt assembly and the second endless loop drive belt assembly is further defined as comprising an overall length which is greater than the maximum length of any container being processed by said system.

5. The system defined in claim 4, wherein the container is further defined as comprising cooperating, forwardly protruding flanges formed on the lid and base thereof, with the locking elements being integrally formed on said flanges, and the elongated, container engaging gap being positioned for receiving the forwardly protruding flanges of the container, when in juxtaposed, spaced, aligned relationship with each other, and simultaneously forcing the locking elements formed on the flanges into locked, secure interengagement with each other.

6. The system defined in claim 5, wherein said container is further defined as comprising a lid portion integrally secured to the base along the one edge of thereof, thereby forming a clamshell construction, and the forwardly protruding flanges formed on the lid and the base are positioned along the edge of the container opposite the hinged edge.

7. The system defined in claim 6, wherein the locking elements comprise at least two lugs formed in one flange and at least two cooperating wells formed in the other flange, said lugs and wells being securely engaged with each other simultaneously upon passage through the elongated gap.

8. The system defined in claim 6, wherein the flanges each comprise cooperating, elongated, mating locking means formed along the length thereof, said mating locking means being simultaneously interengaged in their entirety upon passage through the elongated gap.

9. The system defined in claim 3, wherein the first endless loop belt drive assembly and the second endless loop belt drive assembly are further defined as a being cooperatively mounted on a support plate positioned adjacent the conveyor.

10. A system for securely affixing locking elements of a lid of a container with cooperating locking elements of a base of the container, said system comorising:

A. a support table constructed for enabling containers to be moved thereon;

B. a conveyor belt mounted to the support table and constructed for transferring the containers along the length of the table; and C. a container securing section mounted to the support table and comprising a. a support plate positioned adjacent the conveyor, b. a first endless loop belt drive assembly mounted to the support plate and positioned in cooperating relationship with the conveyor, and c. a second endless loop belt drive assembly, mounted to the support plate and positioned in cooperating relationship with the first endless loop belt drive assembly defining therebetween an elongated, container engaging gap and d. first control means controllably engaged with the support plate for simultaneously raising and lowering the first and second endless loop belt drive assemblies relative to the conveyor, thereby enabling the position of the elongated gap relative to the conveyor to be easily adjusted for any sized container;

whereby containers moving on the conveyor are advanced into engagement with the container engaging gap of the endless loop drive belt assemblies wherein the locking elements of the container are securely engaged with each other.

11. The system defined in claim 10, wherein each of the endless loop belt drive assemblies comprises a reinforcing plate positioned adjacent the portion of the belt forming the gap, thereby preventing movement of the belt away from the gap.

12. The system defined in claim 11, wherein said system further comprises second control means controllably engaged with the reinforcing plate of the first endless loop belt drive assembly for raising and lowering the reinforcing plate of the first endless loop belt drive assembly relative to the reinforcing plate of the second endless loop belt drive assembly, thereby enabling the vertical distance between the first and second endless loop belt drive assemblies to be easily adjusted for accommodating various container configurations.

13. The system defined in claim 12, wherein said system further comprises an elongated, longitudinally extending guide rail assembly mounted to the support table in cooperating association with the conveyor belt for controllably guiding the travel path of each container as the container moves with said conveyor.

14. The system defined in claim 13, wherein said guide rail assembly is further defined as comprising two separate and independent elongated rail members cooperatively associated with each other and positioned in juxtaposed, spaced, cooperating relationship.

15. The system defined in claim 14, wherein said guide rail assembly further comprises a holding plate mounted to each of said rail members for enabling the spaced distance between said rail members to be controllably altered.

16. The system defined in claim 15, wherein the container is further defined as comprising elongated, cooperating sealing components formed on the lid and the base of the container, peripherally surrounding the entire container for enabling the entire outer peripheral edge of the container to be sealed, and the rail members forming the guide rail assembly are adjusted for establishing a gap therebetween which is dimensioned to securely, lockingly engage the perimeter sealing elements formed along the one edge of the container, while the sealing elements formed on the juxtaposed, spaced, parallel edge of the container are lockingly interengaged by the endless loop drive belt assemblies.

17. The system defined in claim 16, wherein the lid of the container is further defined as being integrally attached to the base of the container along one edge thereof, thereby forming a clamshell perimeter seal construction.

18. A system for securely closing and locking containers having a cover joined along one edge to a base by a hinge, with the cover and the base each incorporating an outwardly extending flange formed along the edge thereof opposite the hinge, with each flange incorporating locking means formed therein adapted for secure interengagement with each other when said flanges are pressed together, said system comprising:

A. a support table constructed for enabling the containers to be moved thereon;

B. a conveyor belt mounted to the support table and constructed for transferring the containers along the length thereof;

C. a container securing section mounted to the support table and comprising a. a support plate supportingly positioned adjacent the table in cooperating relationship with the conveyor surface, b. a first endless loop belt drive assembly positioned in cooperating relationship with the conveyor and comprising a first wheel mounted to the support plate for rotational movement about a central axis thereof, a second wheel mounted to the support plate for rotational movement about a central axis thereof and positioned in cooperating, juxtaposed, spaced, adjacent, planar alignment with the first wheel, and an endless loop belt member peripherally surrounding the first wheel and the second wheel and constructed for being rotationally driven by the rotational movement of the first wheel and the second wheel, c. a second endless loop belt drive assembly positioned in cooperating relationship with the first endless loop belt drive assembly defining therebetween an elongated, container engaging gap, and comprising a third wheel mounted to the support plate for rotational movement about a central axis thereof, a fourth wheel mounted to the support plate for rotational movement about a central axis thereof and positioned in cooperating, juxtaposed, spaced, adjacent, planar alignment with the first wheel, and an endless loop belt member peripherally surround the third wheel and the fourth wheel and constructed for being rotationally driven by the rotational movement of the first wheel and the second wheel, d. said container engaging gap extending longitudinally substantially parallel to the surface of the conveyor and positioned for engaging the outwardly extending flanges of the container and dimensioned for compressing the locking means formed on the flanges into secure interengagement with each other;

D. first control means controllably engaged with the support plate for simultaneously raising and/or lowering the support plate for the first and second endless loop belt drive assemblies relative to the conveyor, thereby enabling the position of the elongated gap relative to the conveyor lo be easily adjusted for any sized container;

whereby the containers moving on the conveyor are advanced for causing the flanges thereof to be moved into interengagement with the container engaging gap of the endless loop drive belt assemblies wherein the locking elements formed along the flanges are simultaneously securely engaged with each other.

19. The system defined in claim 18, wherein the elongated, container engaging gap formed between the first endless loop drive belt assembly and the second endless loop drive belt assembly is further defined as comprising an overall length which is greater than the maximum length of any container being processed by said system.

20. The system defined in claim 19, wherein the support plate is further defined as being vertically movable along two support roads securely mounted at their opposed ends to mounting blocks and the first control means comprises a threaded shaft rotationally mounted in a cooperating bushing secured to the support late, whereby rotation of the shaft causes vertical movement of the support plate along the rods.

21. A system for securely closing and locking containers having a cover joined along one edge to a base by a hinge, with the cover and the base each incorporating an outwardly extending flange formed along the edge thereof opposite the hinge, with each flange incorporating locking means formed therein adapted for secure interengagement with each other when said flanges are pressed together, said system comprising:

A. a support table constructed for enabling the containers to be moved thereon;

B. a conveyor belt mounted to the support table and constructed for transferring the containers along the length thereof;

C. a container securing section mounted to the support table and comprising a. a support plate supportingly positioned adjacent the table in cooperating relationship with the conveyor surface, b. a first endless loop belt drive assembly positioned in cooperating relationship with the conveyor and comprising a first wheel mounted to the support plate for rotational movement about a central axis thereof, a second wheel mounted to the support plate for rotational movement about a central axis thereof and positioned in cooperating, juxtaposed, spaced, adjacent, planar alignment with the first wheel, and an endless loop belt member peripherally surrounding the first wheel and the second wheel and constructed for being rotationally driven by the rotational movement of the first wheel and the second wheel, c. a second endless loop belt drive assembly positioned in cooperating relationship with the first endless loop belt drive assembly defining therebetween an elongated, container engaging gap, and comprising a third wheel mounted to the support plate for rotational movement about a central axis thereof, a fourth wheel mounted to the support plate for rotational movement about a central axis thereof and positioned in cooperating, juxtaposed, spaced, adjacent, planar alignment with the first wheel, and an endless loop belt member peripherally surround the third wheel and the fourth wheel and constructed for being rotationally driven by the rotational movement of the first wheel and the second wheel, d. said container engaging gap extending longitudinally substantially parallel to the surface of the conveyor and positioned for engaging the outwardly extending flanges of the container and dimensioned for compressing the locking means formed on the flanges into secure interengagement with each other;

D. a first reinforcing plate positioned between the first wheel and the second wheel of the first endless loop belt drive assembly for controlling the vertical movement of the endless loop belt member;

E. a second reinforcing member positioned between the third wheel and the fourth wheel of the second endless loop belt drive assembly for controlling the vertical movement of the endless loop belt; and F. second control means controllably engaged with the first reinforcing plate for raising and/or lowering the first reinforcing plate relative to the second reinforcing plate, thereby enabling the vertical distance between the first and second endless loop belt drive assemblies to be easily adjusted for accommodating various container configurations.

22. The system defined in claim 21, wherein said system further comprises G. an elongated, longitudinally extending guide rail assembly mounted to the support table in cooperating association with the conveyor belt for controllably guiding the travel path of each container as the container moves with said conveyor.

23. The system defined in claim 21, wherein the first reinforcing plate is further defined as being vertically movable along two spaced rods mounted to the support plate and the control means comprises a threaded shaft mounted in a cooperating bushing mounted in the support plate with the terminating end of the shaft rotationally secured to the first reinforcing plate.

24. A system for securely closing and locking containers having a cover joined along one edge to a base by a hinge, with the cover and the base each incorporating an outwardly extending flange formed along the edge thereof opposite the hinge, with each flange incorporating locking means formed therein adapted for secure interengagement with each other when said flanges are pressed together, said system comprising:

A. a support table constructed for enabling the containers to be moved thereon;

B. a conveyor belt mounted to the support table and constructed for transferring the containers along the length thereof;

C. a container securing section mounted to the support table and comprising a. a support plate supportingly positioned adjacent the table in cooperating relationship with the conveyor surface, b. a first endless loop belt drive assembly positioned in cooperating relationship with the conveyor and comprising a first wheel mounted to the support plate for rotational movement about a central axis thereof, a second wheel mounted to the support plate for rotational movement about a central axis thereof and positioned in cooperating, juxtaposed, spaced, adjacent, planar alignment with the first wheel, and an endless loop belt member peripherally surrounding the first wheel and the second wheel and constructed for being rotationally driven by the rotational movement of the first wheel and the second wheel, c. a second endless loop belt drive assembly positioned in cooperating relationship with the first endless loop belt drive assembly defining therebetween an elongated, container engaging gap, and comprising a third wheel mounted to the support plate for rotational movement about a central axis thereof, a fourth wheel mounted to the support plate for rotational movement about a central axis thereof and positioned in cooperating, juxtaposed, spaced, adjacent, planar alignment with the first wheel, and an endless loop belt member peripherally surround the third wheel and the fourth wheel and constructed for being rotationally driven by the rotational movement of the first wheel and the second wheel, d. said container engaging gap extending longitudinally substantially parallel to the surface of the conveyor and positioned for engaging the outwardly extending flanges of the container and dimensioned for compressing the locking means formed on the flanges into secure interengagement with each other;

D. first control means controllably engaged with the support plate for simultaneously raising and/or lowering the support plate for the first and second endless loop belt drive assemblies relative to the conveyor, thereby enabling the position of the elongated gap relative to the conveyor to be easily adjusted for any sized container;

E. a first reinforcing plate positioned between the first wheel and the second wheel of the first endless loop belt drive assembly for controlling the vertical movement of the endless loop belt member;

F. a second reinforcing member positioned between the third wheel and the fourth wheel of the second endless loop belt drive assembly for controlling the vertical movement of the endless loop belt; and G. second control means controllably engaged with the first reinforcing plate for raising and/or lowering the first reinforcing plate relative to the second reinforcing plate, thereby enabling the vertical distance between the first and second endless loop belt drive assemblies to be easily adjusted for accommodating various container configurations;

whereby the containers moving on the conveyor are advanced for causing the flanges thereof to be moved into interengagement with the container engaging gap of the endless loop drive belt assemblies wherein the locking elements formed along the flanges are simultaneously securely engaged with each other.

25. The system defined in claim 24, wherein the first reinforcing plate is further defined as being vertically movable along two spaced rods mounted to the support plate and the control means comprises a threaded shaft mounted in a cooperating bushing mounted in the support plate with the terminating end of the shaft rotationally secured to the first reinforcing plate.

26. The system defined in claim 25, wherein the support plate is further defined as being vertically movable along two support rods securely mounted at their opposed ends to mounting blocks and the first control means comprises a threaded shaft rotationally mounted in a cooperating bushing secured to the support late, whereby rotation of the shaft causes vertical movement of the support plate along the rods.

* * * * *